United States Patent [19]

Wallin et al.

[11] 4,209,913

[45] Jul. 1, 1980

[54] METHOD AND DEVICE FOR DRYING GLOVES

[76] Inventors: Lloyd A. Wallin, 1200 Red Oak Ct. North, Burnsville, Minn. 55337; David E. Filkins, Big Leach Resort, Walker, Minn. 56484

[21] Appl. No.: 864,695

[22] Filed: Dec. 27, 1977

[51] Int. Cl.[2] ..... F26B 7/00

[52] U.S. Cl. ..... 34/21; 34/103; 223/51; 223/66; 223/79

[58] Field of Search ..... 34/103–106, 34/21, 60; 223/51, 78, 79, 80, 66, 68, 86, 24; 8/150, 150.5

[56] References Cited

U.S. PATENT DOCUMENTS

| | | | |
|---|---|---|---|
| 1,543,829 | 6/1925 | Doyle | 223/79 |
| 1,562,631 | 11/1925 | Goltman | 223/79 |
| 1,736,679 | 11/1929 | Tierney | 223/78 |
| 1,981,527 | 11/1934 | Schlag et al. | 223/78 |
| 2,546,518 | 3/1951 | O'Farrell et al. | 223/86 |
| 3,479,749 | 11/1969 | Del Moral | 34/103 |
| 3,917,266 | 11/1975 | Kiey | 223/78 |
| 4,084,733 | 4/1978 | Perlmutter | 223/78 |

*Primary Examiner*—Larry I. Schwartz

*Attorney, Agent, or Firm*—Merchant, Gould, Smith, Edell, Welter & Schmidt

[57] ABSTRACT

A method and device for drying gloves, particularly golf gloves, comprises a drying member shaped to resemble a human hand. The drying member is sufficiently rigid such that the golf glove is inserted thereon and retained in an open orientation substantially conforming to the orientation in which the glove is normally worn on a human hand. However, the drying member is also semi-resilient such that the drying member may be temporarily deformed inwardly to allow the glove to be removed therefrom. In one embodiment, the drying member is hollow having a plurality of perforations therein. This allows ambient air or a drying medium, such as heated air, to be circulated from the interior of the drying member into contact with the glove for the purpose of drying the glove.

1 Claim, 3 Drawing Figures

FIG. 1
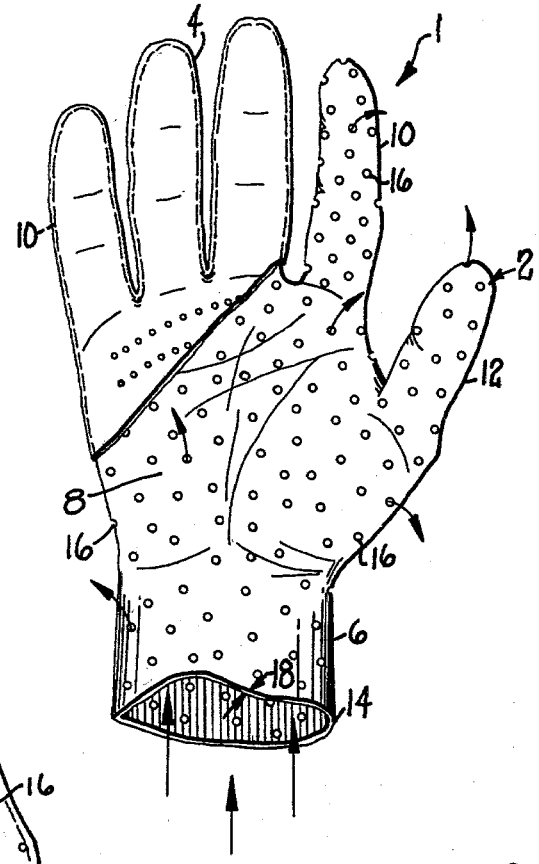
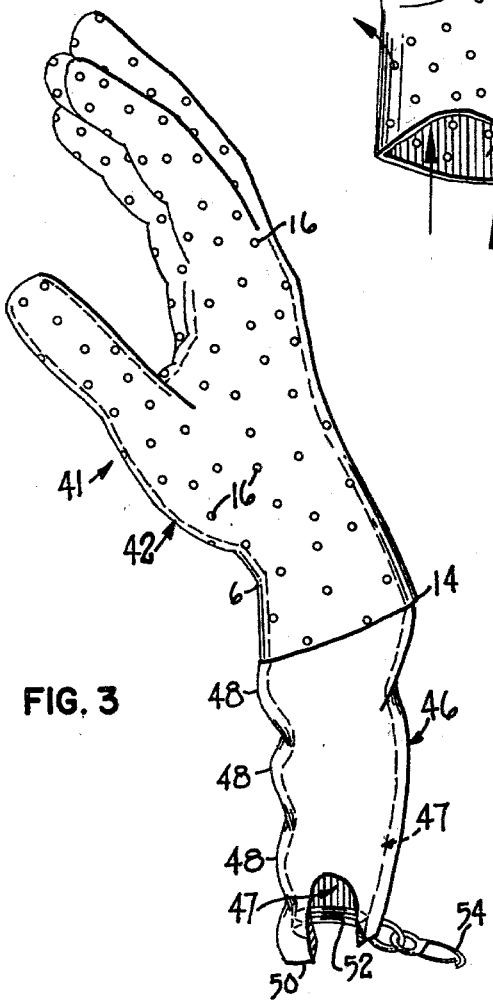
FIG. 3
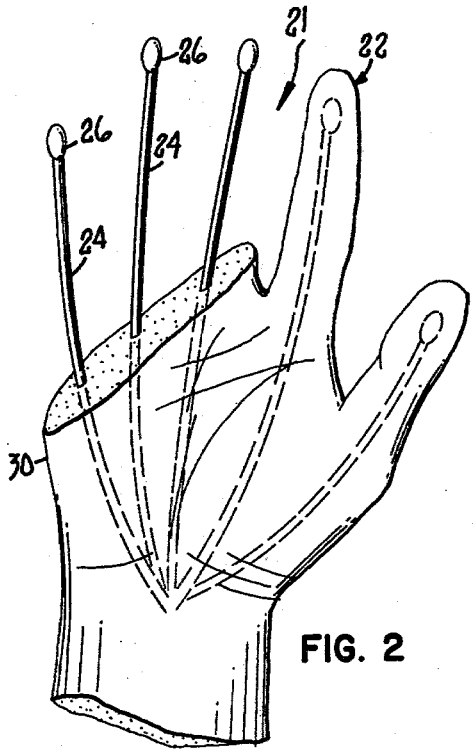
FIG. 2

METHOD AND DEVICE FOR DRYING GLOVES

BACKGROUND OF THE INVENTION

1. Field of the Invention

The present invention relates generally to devices which are suitable for drying gloves and which are particularly suitable for drying gloves made from leather, such as golf gloves. The present invention also relates to devices which simultaneously dry a glove and retain the shape of the glove as normally worn on a human hand.

2. Description of the Prior Art

Golf is a game which enjoys great popularity not only in the United States but throughout the world. Many golfers wear at least one golf glove while golfing to assist them in gripping the golf club and, hopefully, to improve their golf score. Golf gloves are generally light-weight and durable and are usually made in whole or in part from leather. Such gloves also generally comprise a plurality of fingers into which the fingers and thumb of the hand are inserted. In certain instances, the finger portions of the glove do not extend to the end of the fingers (i.e. the gloves are "open-fingered"). In addition, the golf glove usually has a plurality of perforations. These perforations provide passageways to the golfer's hand which allow perspiration to escape and evaporate through the glove.

After playing a round of golf in typical golfing weather, (i.e. in an ambient temperature range of from 50°-100° F.), the golf glove worn by the typical golfer is often wet (e.g. soaked with perspiration). It has been customary for most golfers to simply take the glove off and place it into their golf bag or the like until the next time they play. Thus, the golf glove generally dries in a wrinkled shape as it is lying in the bottom of the golf bag or in one of the pockets of the golf bag.

The above-noted treatment of a golf glove is disadvantageous. It is a well-known fact that leather shrinks as it dries. Thus, as the golf glove dries in the golf bag, it tends to shrivel up to form a compact little ball. Further, the glove tends to become very stiff and wrinkled. When the golfer attempts to wear the golf glove when he begins playing his next round of golf, it takes him a little while to open the golf glove so that he can put it onto his hand. In addition, because the golf glove has become stiff and wrinkled, it also takes a little while as the golfer wears the glove during the round for the glove to soften up properly. Thus, for the first few holes of the next round of golf, the golfer might experience some degree of discomfort due to the fact that the golf glove is still somewhat stiff after being stored in the golf bag. This discomfort might well affect the golfer's play during these first few holes.

Another problem associated with the customary use and care of a golf glove is that the drying and shriveling of the glove in the manner noted above over a prolonged period of time will loosen the stitching on the glove. This shortens the life of the golf glove. Consequently, a golfer has to replace the glove more often that would be strictly necessary if the shape of the glove were retained as it is dried. In addition, merely throwing and storing the golf glove in the golf bag after each round means that it sometimes can be very difficult to find the glove before the next round of golf can be played. For example, when the glove is merely thrown loose into the bag, it often tends to settle to the bottom of the bag. The golf glove may be difficult to retrieve from such a location without first removing all the clubs from the bag. Such a procedure is often aggravating to the golfer.

SUMMARY OF THE INVENTION

One aspect of the present invention is a golf glove drying member which retains the normal shape of the golf glove (i.e. as worn on a human hand) as the glove is drying. This prevents the glove from shriveling and getting stiff. An additional aspect of this invention is the provision of a drying member which allows for easy storage and accessibility of the golf glove.

The present invention comprises a golf glove drying member which is configured to substantially resemble a human hand. In a preferred method of using this drying member, the golf glove is placed onto the drying member in an open orientation which is similar to an orientation in which the glove is worn on a human hand. Placement of the golf glove on the member in this manner will assist ambient air in drying the golf glove. It will also retain the shape of the golf glove as it dries, thereby preventing any shriveling or crinkling of the glove. The golf glove is left on the drying member a sufficient length of time to allow the glove to completely dry, and then it is removed from the drying member. Although the drying member is normally rigid to maintain the glove in its substantially open orientation, the drying member is also made to be inwardly collapsible or deformable. This allows the golfer to crush or inwardly deform the drying member to allow the glove to be removed therefrom.

BRIEF DESCRIPTION OF THE DRAWINGS

The present invention will be described hereafter in the Detailed Description, taken in conjunction with the following drawings, in which like numerals will represent like elements throughout.

FIG. 1 is a perspective view of a first embodiment of a golf glove drying device according to the present invention;

FIG. 2 is a perspective view of a second embodiment of a golf glove drying device according to the present invention; and FIG. 3 is a perspective view of a third embodiment of a golf glove drying device according to the present invention.

DETAILED DESCRIPTION

Referring first to FIG. 1, a first embodiment of a golf glove drying device according to the present invention is generally indicated as 1. Drying device 1 comprises a drying frame or drying member 2. Drying member 2 is designed for retaining and drying a golf glove 4 or the like. Drying member 2 is three dimensional and is shaped in a configuration substantially resembling that of a human hand. In other words, drying member 2 is provided with a wrist portion 6, a palm portion 8, and four fingers 10 and a thumb 12. Fingers 10 and thumb 12 all extend outwardly from palm portion 8 in a manner generally identical to a hand which is in a slightly flexed orientation.

Drying member 2 is formed in a hollow manner having an open end 14 generally adjacent wrist portion 6. In addition, drying member 2 is provided with a plurality of holes or perforations 16 over its entire surface. Moreover, drying member 2 is formed so that the walls of the drying member have a substantially uniform cross-sectional thickness, generally indicated as 18. Thickness 18 is selected to fall in a range such that, in conjunction with the hardness or resilience of the material comprising the drying member, certain desirable characteristics are achieved for drying member 2. These characteristics include the ability of drying member 2 to have a normal orientation in which the drying member is substantially rigid. In such a normal orientation, drying member 2 is able to maintain the glove 4 thereon in an open orientation corresponding to the orientation in which glove 4 is normally worn on a human hand. However, in order to easily remove glove 4 from drying member 2, drying member 2 should also be temporarily collapsible under the application of an external force (e.g. by squeezing). This allows drying member 2 to be inwardly crushed or deformed by the golfer to remove glove 4 from drying member 2. After the glove 4 is so removed, the resilience of the material comprising drying member 2 restores the drying member to its normal orientation.

Drying member 2 is preferably made from a semiresilient plastic material. This plastic material preferably is the same type of material which is used to manufacture the plastic practice golf balls which are customarily known as "whiffle balls". Applicants believe this plastic material to be some type of styrene copolymer. For example, drying member 2 may be made from ABS polystyrene (acrylonitrile-butadiene-styrene). However, any materials could be used to manufacture drying member 2 which give the two desirable characteristics noted above with proper consideration being given to the selection of thickness 18 and the resilience of the material. In other words, any materials can be used which allow drying member 2 to be normally rigid, but which also allow drying member 2 to temporarily collapse under the application of an external force. When drying member 2 is made from a plastic material, any conventional molding process, such as injection or blow molding, may be used to manufacture drying member 2.

In a preferred method of using drying member 2, after a golfer is finished golfing, he takes his golf glove 4 off and places it onto drying member 2 in a substantially open orientation. Ambient air is able to flow through the open end 14 of drying member 2 and into the interior of drying member 2. The air then flows outwardly through the perforations 16 in drying member 2 to contact and to thoroughly dry golf glove 4. Because golf glove 4 is dried as it is retained in an open orientation on drying member 2, it does not shrivel or crinkle. Instead, its shape is retained in an orientation which corresponds to that in which the glove is normally worn on the golfer's hand.

Golf glove 4 is left on drying member 2 for a sufficient length of time to completely dry the glove. This time will vary depending on how wet or damp the glove 4 is and the drying capabilities (i.e. the temperature and relative humidity) of the ambient air. Generally, however, golf glove 4 will dry in a period of a few hours (e.g. 3–24 hours). As golf glove 4 dries, it will generally shrink tightly onto drying member 2 since glove 4 is usually made at least partially of leather. After the golf glove has completely dried, it may be left by the golfer on the drying member 2 until the next time it is desired to use the glove. In order to remove the dried golf glove 4 from drying member 2, it is necessary to manually crush or inwardly deform the drying member, as by squeezing the drying member. Thus, the fingers 10, thumb 12 and palm portion 10 or drying member 2 are temporarily collapsed to allow golf glove 4 to be slipped off the drying member. In this regard, a lubricant, such as oil, might be applied to the drying member before the golf glove is placed thereon. This lubricant would assist the glove in slipping off the drying member. Although a drying member 2 which is not capable of being deformed inwardly would be sufficient to dry golf glove 4, it would be somewhat more difficult to remove the glove (especially a leather glove) from such a non-collapsible drying member. However, a non-collapsible drying member could be used if desired for this purpose and would be especially suited for retaining and drying gloves which do not shrink significantly when they dry.

FIG. 2 illustrates a second embodiment of a drying device 21 according to the present invention. Drying device 21 comprises a drying member generally indicated as 22. Drying member 22 comprises five substantially rigid and elongated plastic support rods 24. Each rod 24 has an oval knob or retaining member 26 integrally formed at one end thereof. Rods 24 have various lengths and are oriented relative to one another to generally resemble at least the skeletal configuration of the fingers and thumb of a human hand. In addition, rods 24 are fixedly connected together at the ends thereof which are opposite to retaining knobs 26. However, it is not strictly necessary for the rods 24 to be directly connected together at the ends thereof; they may be unconnected if so desired.

Drying member 22 also includes a resilient outer covering 30. Covering 30 totally encases rods 24 and provides drying member 22 with an exterior configuration resembling that of a human hand. In other words, drying member 22 will have its resilient covering 30 shaped in the form of a hand generally similar to FIG. 1, i.e. a hand in a generally flexed orientation having a wrist portion, a palm portion, four spaced fingers and a thumb. Oval knobs 26 serve to lock or retain the resilient covering 30 to the outer ends of support rods 24. In this regard, each knob 26 may be serrated or toothed to give the covering 30 a better frictional engagement.

In using drying member 22, golf glove 4 is slipped onto the drying member and retained thereon in a manner substantially similar to the drying member 2 of FIG. 1. Drying member 22 is substantially rigid in a normal orientation by virtue of the rigidity of support rods 24. However, resilient outer covering 30 allows drying member 22 to be deformed inwardly to remove golf glove 4 therefrom. In other words, when it is time to remove golf glove 4 after it has dried, the golfer need only squeeze or compress the covering 30. This decreases the exterior size of drying member 22 and allows glove 4 to be slipped off of the drying member. Resilient covering 30 comprises a compressible foam or sponge material. More particularly, a resilient styrofoam material is preferred for covering 30.

In a manner of manufacturing drying member 22, a suitable mold is first made of a human hand. Support rods 24 are then arranged inside the mold with the rods extending upwardly into the finger and thumb cavities of the mold. Styrofoam is then injected into the mold such that it completely covers and encases rods 24 and forms the exterior configuration of drying member 22. The amount of resiliency or deformability of the styrofoam material may be suitably adjusted by controlling the amount of gas (e.g. freon) which is injected into the styrofoam material as it is being formed in a generally conventional process.

Referring now to FIG. 3, a third embodiment of a golf glove drying device according to the present invention is generally illustrated as 41. Drying device 41 comprises a hand shaped drying member 42. Drying member 42 is substantially identical to drying member 2 shown in FIG. 1. However, the open end 14 of drying member 42 adjacent to the wrist portion 6 has an outwardly extending handle member 46. Handle member 46 is integrally formed with drying member 42 to constitute a continuation thereof. In this regard, handle member 46 has an elongated bore 47 passing therethrough which allows ambient air or some other drying medium to pass into the interior of hollow drying member 42. In addition, handle member 46 has a plurality of curves or undulations 48 provided in its exterior surface to provide a pistol-type grip thereon. Handle member 46 terminates in an exterior end 50. End 50 has an internally threaded socket 52 provided therein. In addition, handle member 46 has a snap ring 54 provided on its exterior surface.

Handle member 46 enables a golfer to easily use and manipulate drying device 41. For example, the golfer can simply hold drying member 42 by the pistol grip 48 provided on handle 46 in placing or removing a golf glove 4 onto the drying member 42. Although a golfer is able to hold drying member 42 without having a handle 46 provided thereon (e.g. as in drying member 2 of FIG. 1), handle 46 facilitates the handling of drying member 42 and makes it somewhat easier to use. After the golfer has placed the golf glove onto the drying member 42, he can then easily store the drying member 42 by simply clipping it to a strap on his golf bag by means of snap ring 54. Thus, golf glove 4 will be retained on drying member 42 and will conveniently hang from the golf bag by means of snap ring 54 until its next use.

Internal socket 52 provides an attachment or coupling means through which the drying member 42 may be connected to a drying device. More particularly, a portable hair dryer (not shown) or the like having an outlet hose may be coupled to the internal socket 52 through a threaded male coupling on the end of the outlet hose. When the hair dryer is actuated after being coupled to drying member 42, a flow of heated air (e.g. at 100°-150° F.) is directed upwardly through bore 47 in the handle 46. The heated air then flows through perforations 16 in the exterior surface of drying member 42 to contact the glove. This flow of warm air speeds up the drying of golf glove 4. This decrease in the drying time of the glove may be necessary when the glove must be dried for reuse in a relatively short period of time (e.g. on the order of an hour or less) and whenever ambient air cannot dry the glove 4 in the required length of time.

Only one particular orientation and size of the drying member has been shown in the three embodiments illustrated in FIGS. 1-3. However, the drying members 2, 22 and 42 can all be manufactured in various sizes for receiving differently sized golf gloves. For example, these drying members would preferably be manufactured in small, medium, large and extra large sizes. In addition, all of these drying members would be manufactured in both a right hand and a left hand orientation. Thus, a golfer who wears his golf glove on his right hand would purchase a right hand oriented drying member in the proper size for receiving his golf glove. Similarly, a golfer who wears his glove on his left hand would buy a left hand oriented drying member.

All three of the embodiments of the drying member disclosed herein have various advantages. They all provide a method and device for drying a golf glove while simultaneously retaining and preserving the shape of the glove as it is normally worn on the golfer's hand. This prevents the golf glove from shriveling and shrinking as it dries. Thus, the golfer does not have to unravel the golf glove before it can be used. In addition, the golfer will find that the golf glove after it is removed from the drying member will already conform to the shape of his hand as he next begins to play. Thus, there is no period of time in which the golfer experiences discomfort because the golf glove is still softening up and trying to conform to the shape of his hand after first having been shriveled. Furthermore, because the golf glove is no longer periodically shriveled and then stretched out again, the stitching in the glove will not loosen very much. The life of the glove is thereby prolonged. If desired, a leather conditioner could be sprayed, brushed or otherwise applied to the drying member before the golf glove is placed thereon. As the golf glove dries on the drying member, the leather conditioner will be impregnated with the glove. This conditioner will soften and preserve the leather in the glove, thereby further extending the glove's life.

In addition, all of the drying members of the present invention provide a convenient structure for storing the golf glove. Because the golf glove is no longer merely thrown in the bottom of the golfer's golf bag but is retained on a three dimensional drying member, the golf glove will be much easier to find the next time a golfer wishes to golf. This is particularly true of the drying device 41 which can be attached by snap ring 54 to the exterior of the golfer's golf bag. Snap ring 54 may be added if desired to the other two embodiments of the drying members shown in FIGS. 1 and 2. However, because the golf glove 4 is now placed on a three dimensional drying member, it is, therefore, retained in a spread open orientation. Thus, it will be much more easily located by the golfer even if the drying member is merely placed somewhere inside the golf bag. This easy accessibility will reduce the aggravation sometimes encountered when a golfer has to search his entire bag to find a shriveled up golf glove which has settled to the bottom of the bag.

The present invention is primarily intended for use with golf gloves. However, the drying members disclosed herein can be used to dry gloves used for any purpose and made from materials other than leather. In addition, the drying members could be used to dry mittens or the like if so desired, simply by replacing the separate finger portions 10 by a solid portion conforming to the shape of the mitten.

Other modifications of the present invention will be apparent to those skilled in the art. Therefore, the scope of the present invention is to be limited only by the appended claims.

What is claimed is:

1. A method for drying a golf glove, which comprises:

(a) providing a three dimensional drying member which substantially resembles a human hand;

(b) applying a conditioning agent for the golf glove onto the drying member before the golf glove is placed thereon, whereby the conditioning agent is imparted to the golf glove as the golf glove dries on the drying member;

(c) placing the golf glove onto the drying member such that the golf glove is maintained thereon in an open orientation similar to that in which the glove may be worn on a human hand;

(d) allowing the golf glove to remain on the drying member for a period of time which is sufficient to dry the golf glove; and (e) removing the golf glove from the drying member after the glove is dry.

* * * * *